US005782341A

United States Patent [19]

Calder et al.

[11] Patent Number: 5,782,341

[45] Date of Patent: Jul. 21, 1998

[54] PADLOCKING ARRANGEMENT FOR HIGH AMPERE-RATED CIRCUIT BREAKER

[75] Inventors: William H. Calder, Plainville; James L. Rosen, West Hartford, both of Conn.

[73] Assignee: General Electric Company, New York, N.Y.

[21] Appl. No.: 578,872

[22] Filed: Dec. 22, 1995

[51] Int. Cl.[6] ..... H01H 9/28

[52] U.S. Cl. ..... 200/43.14; 200/43.11

[58] Field of Search ..... 200/43.11, 43.14, 200/43.15, 43.16, 43.01, 400

[56] References Cited

U.S. PATENT DOCUMENTS 4,001,742 1/1977 Jencks ..... 335/173

5,477,016 12/1995 Baginski ..... 200/43.11

OTHER PUBLICATIONS

U.S. Application No. 08/205,240 Filing date Mar. 3, 1994 Latching Assembly for High Ampere-Rated Circuit Breaker.

*Primary Examiner*—David J. Walczak

*Attorney, Agent, or Firm*—Richard A. Menelly; Carl B. Horton

[57] ABSTRACT

This invention relates to a high ampere-rated circuit breaker which meets the electrical code requirements of the world market. The circuit breaker electronic trip unit is contained within a recess in the circuit breaker cover and is interlocked with the circuit breaker operating mechanism to articulate the operating mechanism upon removal. A padlock assembly arranged within the circuit breaker case prevents the circuit breaker contacts from being closed and the cover from being removed. The padlock assembly is only functional when the circuit breaker contacts are in the OPEN condition.

10 Claims, 4 Drawing Sheets

PADLOCKING ARRANGEMENT FOR HIGH AMPERE-RATED CIRCUIT BREAKER

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of powerful operating springs that are restrained from separating the circuit breaker contacts by means of a latching system.

The latching arrangement within the operating mechanism is described within U.S. patent application Ser. No. 08/205,240 filed Mar. 3, 1994 entitled "Latching Assembly for High Ampere-Rated Circuit Breaker".

The circuit breaker is used with industrial equipment that is usually dismantled for cleaning and repair purposes. In order to prevent inadvertent turnon of the circuit breaker while the associated equipment is under repair, a padlock device is often employed. To prevent padlocking the circuit breaker when the contacts are in a closed condition, it would be desirable to interlock the circuit breaker contacts so that the circuit breaker could not be padlocked and the circuit breaker cover could not be removed to expose the circuit breaker internal components unless the circuit breaker contacts are actually in the OPEN position.

SUMMARY OF THE INVENTION

An industrial-rated circuit breaker having a cover attached to a base unit that contains the internal circuit breaker operating components, including the contacts that carry the circuit current is arranged so that the cover can not be removed when the circuit breaker contacts are padlocked in the OPEN position. A padlock and hasp arrangement on the circuit breaker cover is interlocked with the circuit breaker contacts to prevent the padlock from being engaged with the hasp to lock the circuit breaker contacts unless the contacts are actually in the OPEN position.

DESCRIPTION OF THE PREFERRED EMBODIMENT

Figure 1:
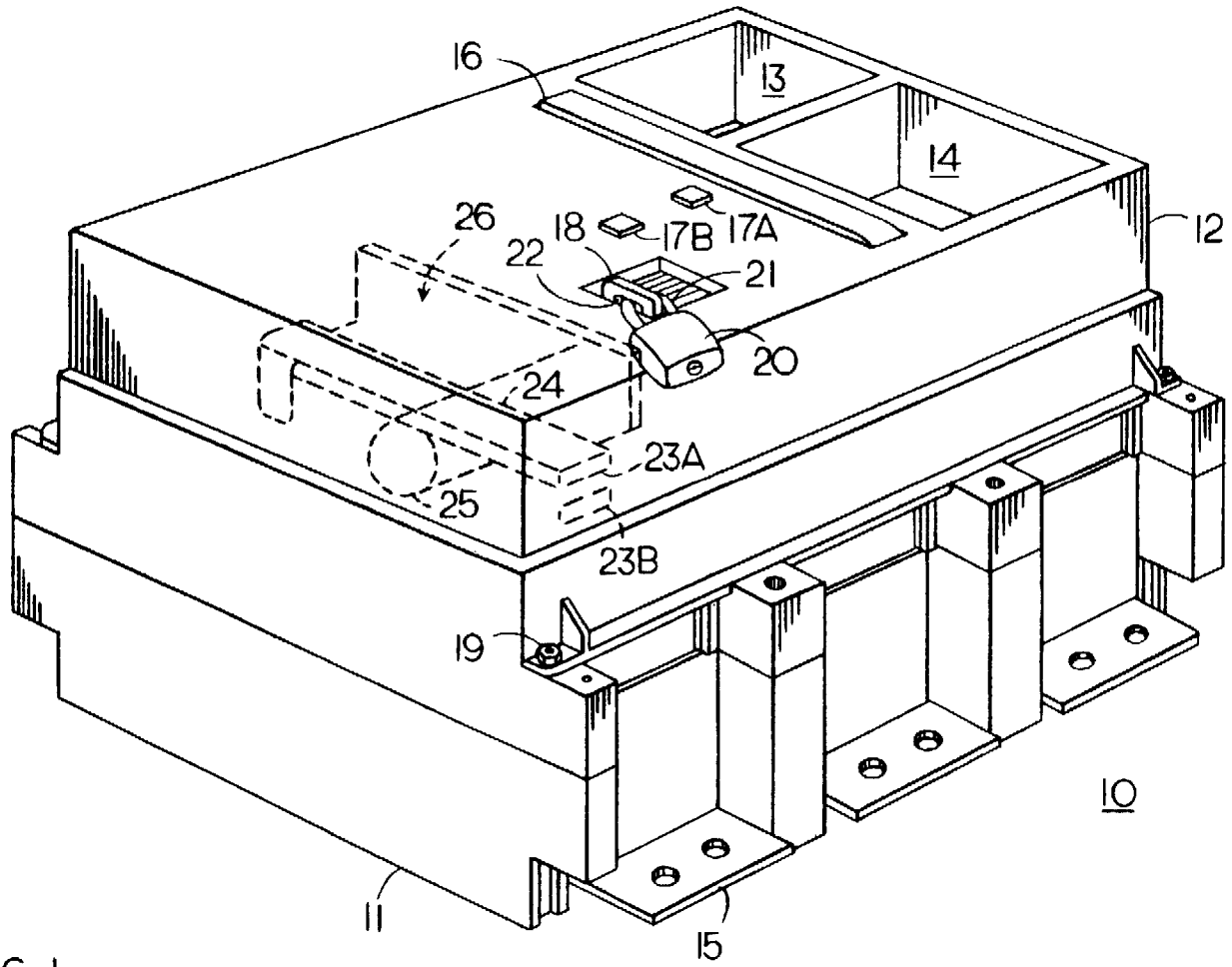
FIG. 1 top perspective view of an industrial-rated circuit breaker with the contacts in the OPEN position and the circuit breaker cover padlocked in accordance with invention.

The industrial-rated circuit breaker 10 is shown in FIG. 1 and includes a case 11 closed by means of a cover 12 both of an electrically-insulative plastic material. As described in the aforementioned U.S. patent application Ser. No. 08/205,240, an accessory recess 13 is formed in the cover to allow field-installable accessory accommodation and a trip unit recess 14 is formed therein to contain an electronic trip unit, not shown. The circuit breaker connects with the associated electrical equipment by means of the load straps 15 extending from one side of the case and with the electrical distribution system by means of the line straps, not shown, which extend from the opposite side thereof. An externally accessible operating handle 16 allows an operator to reset the circuit breaker operating mechanism 26 contained within the cover and the buttons 17A, 17B allow the circuit breaker to be turned ON and OFF in the manner described within the aforementioned U.S. Pat. No. 4,001,742. In accordance with the invention, a locking hasp 18 is arranged on the cover 12 to prevent the contact arm 24 from closing the circuit breaker contacts 23A, 23B and to prevent the cover 12 from being removed from the case 11 by disengagement of the nuts 19 that secure the cover to the case. The locking hasp receives a padlock 20 by insertion of the padlock link 21 within the locking hasp aperture 22. The circuit breaker contacts 23A, 23B and the contact arm 24 are controlled by the closing shaft and latching arrangement contained within the operating mechanism 26 in the manner described within the aforementioned U.S. Patent Application. The interlock between the circuit breaker operating mechanism closing shaft 25 and the locking hasp 18 is best seen by referring to FIGS. 2–4.

Figure 2:
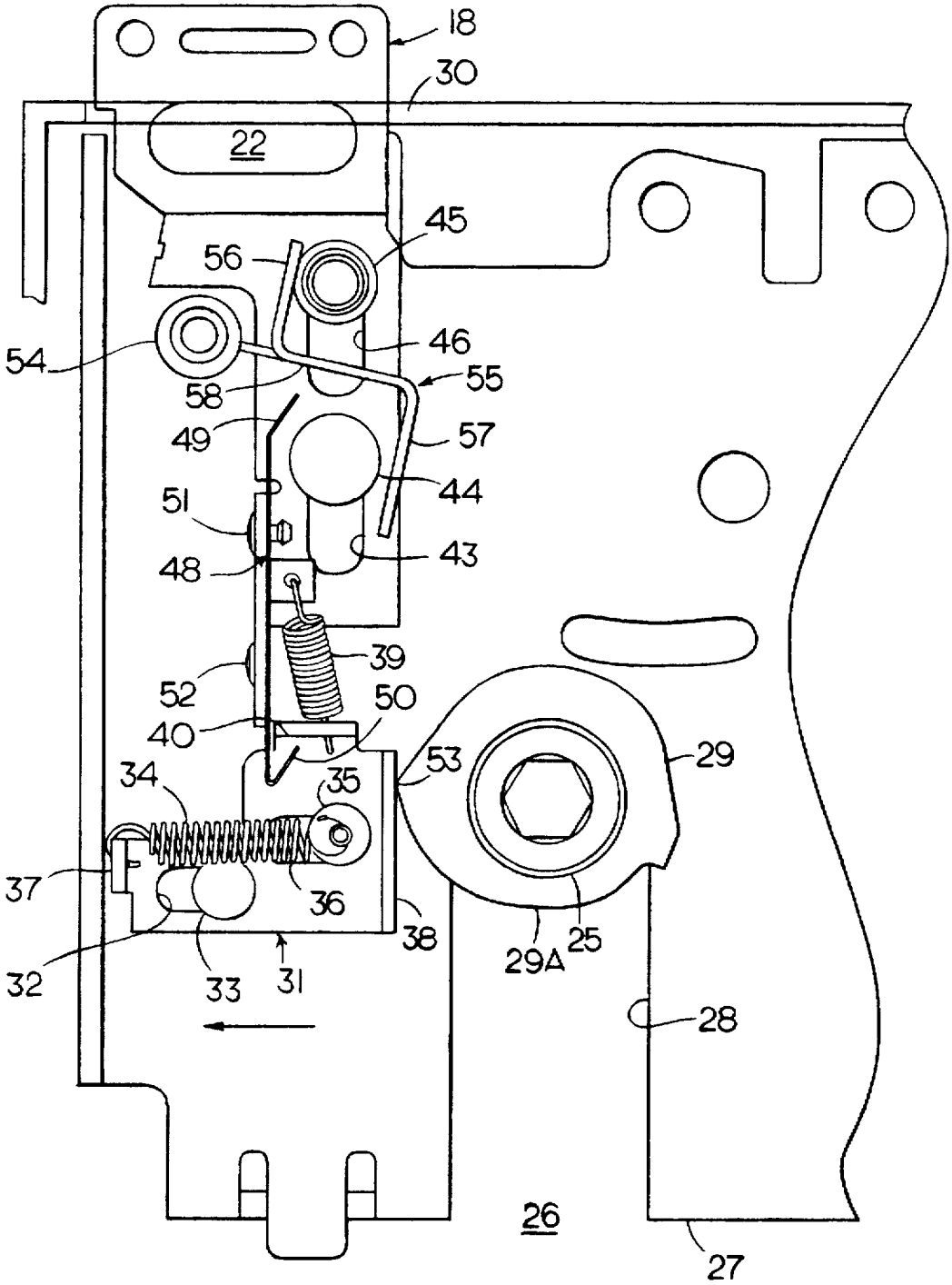
FIG. 2 is an enlarged side view of the interior of the circuit breaker of FIG. 1 depicting the interlock arrangement between the circuit breaker operating mechanism closing shaft and the circuit breaker cover locking hasp when the circuit breaker contacts are in the CLOSED position in accordance with the invention.

A part of the operating mechanism 26 is depicted in FIG. 2 with the closing shaft 25 extending through a slot 28 formed within the operating mechanism side wall 27. Since the OPEN and CLOSED positions of the circuit breaker contacts 23A, 23B of FIG. 1 are determined by the positional rotation of the closing shaft, as described within the aforementioned U.S. Patent Application, a cam slide 31 is positioned next to the closing shaft to interact with the multi-surfaced closing cam 29 that is attached to the perimeter of the closing shaft. The cam slide 31 is carried by a pair of rivets 33, 35 attached to the side frame 27 that are positioned within the corresponding elongated slots 32, 36 are formed within the cam slide. A cam slide return spring 34 is attached to a rear tab 37 at one end and to the rivet 35 at the opposite end to carefully locate the front tab 38 relative to the closing cam 29. A hasp slide 41 formed at the end of the locking hasp 18 is movably-connected with the cam slide 31 by attachment to the top tab 40 at one end and by attachment to the hasp slide at the opposite end as indicated at 42. The hasp slide is carried by means of a pair of rivets 44, 45 attached to the side frame 27 that are positioned with the corresponding elongated slots 43, 46 that are formed within the hasp slide. The locking hasp 18 is positioned within the aperture 30 in the circuit breaker cover 12 such that the aperture 22 is beneath the surface of the circuit breaker cover and is not available for insertion of the padlock 20 shown in FIG. 1. In the rotational position of the closing cam 29, corresponding to the contacts CLOSED position, the node 53 is against the front tab 38 of the cam slide 31. The position of the locking hasp 18 is governed by the leaf spring 48 that is attached to the locking hasp by means of the rivets 51, 52 as indicated. The top end 49 of the leaf spring is arranged for interacting with the circuit breaker latching arrangement in the form of a latching lever 55 connected at one end to the delatch pivot 54 as described in detail within the aforementioned U.S. Patent Application. The latching lever 55 consists of a top arm 56 and a bottom arm 57 which are positioned away from the leaf spring 58 when the circuit breaker contacts are in the CLOSED position. The bottom end 50 of the leaf spring is trapped under the top tab 40 to hold the locking hasp from being manually retracted in the indicated direction to expose the locking hasp aperture 22.

Figure 3:
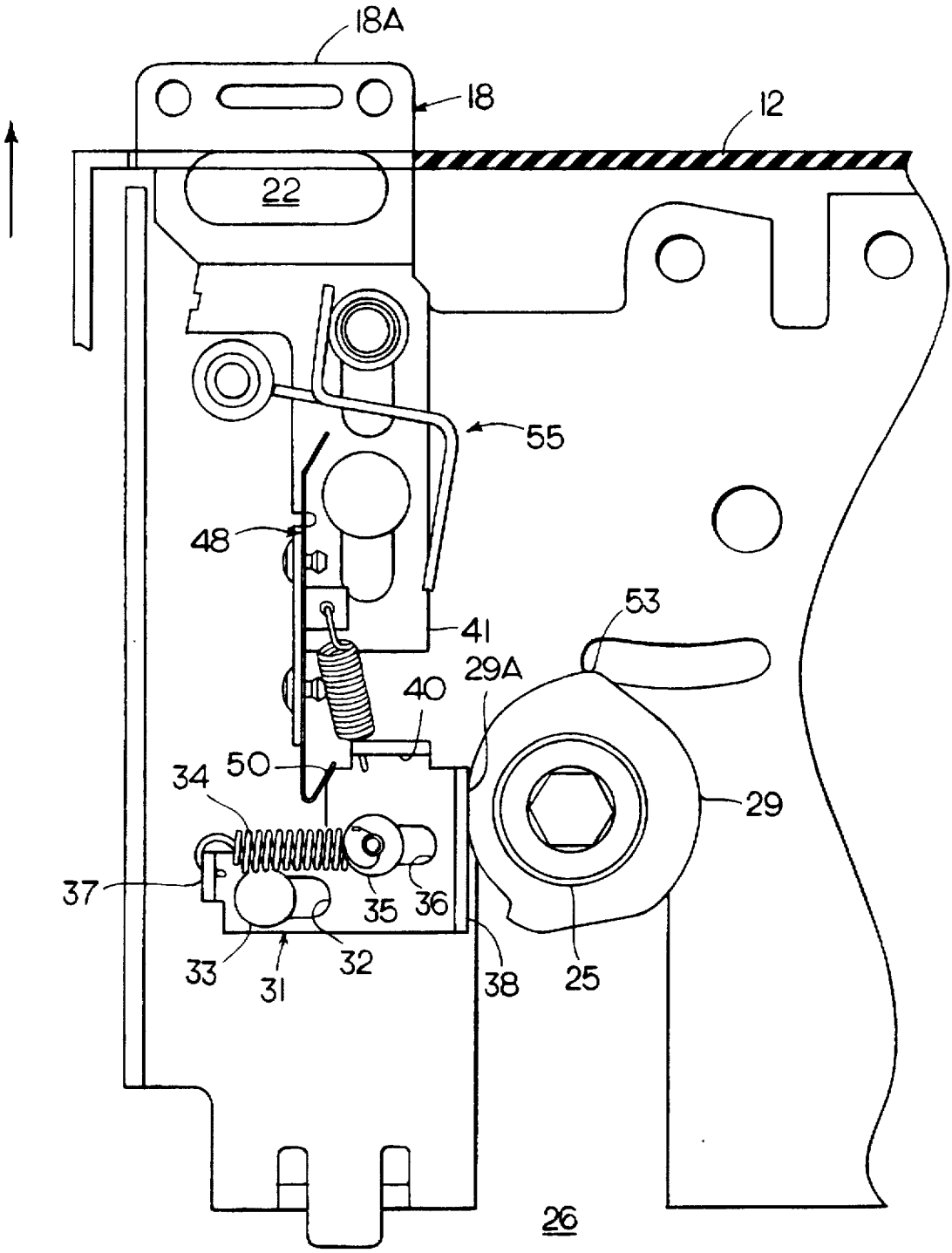
FIG. 3 is an enlarged side view of the interior of the circuit breaker of FIG. 1 depicting the interlock arrangement between the circuit breaker operating mechanism closing shaft and the circuit breaker cover locking hasp when the circuit beaker contacts are in the OPEN position.
Figure 4:
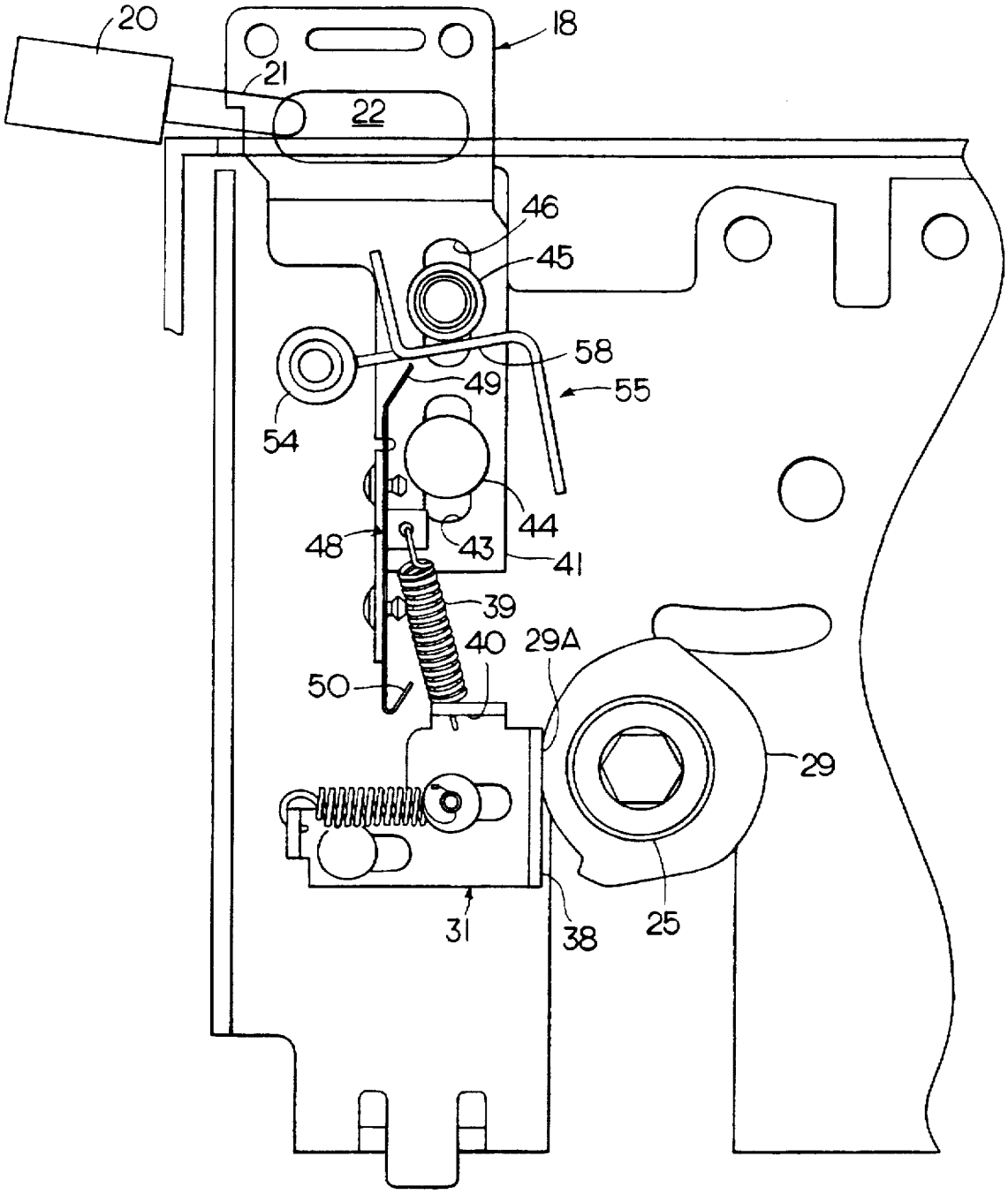
FIG. 4 is an enlarged side view of the interior of the circuit breaker of FIG. 1 depicting the interlock arrangement between the circuit breaker operating mechanism closing shaft and the circuit breaker cover locking hasp when the circuit breaker contacts are in the OPEN position and the padlock is inserted within the locking hasp.

When the closing shaft 25 is rotated in the counter-clock wise direction to move the contacts to the OPEN position, as shown within the part of the operating mechanism 26 shown in FIG. 3, the node 53 on the closing cam 29 moves away from the front tab 38 on the cam slide 31 and the flat surface 29A abuts against the front tab 38 of the cam slide 31 allowing the cam slide return spring 34 to move the cam slide along the rivets 33, 35 within the elongated slots 32, 36 such that the bottom end 50 of the leaf spring 48 is away from under the top tab 40. When the top 18A of the locking hasp 18 is grasped and moved in the indicated direction, the hasp slide 41 is free to translate upwards allowing the hasp aperture 22 to move above the surface of the circuit breaker cover 12 to the position indicated in the part of the operating mechanism 26 shown in FIG. 4. The top end 49 of the leaf spring 48 contacts the flat portion 58 on the latch mechanism operating lever 55 rotating the delatch pivot 54 in the counter-clockwise direction releasing the operating mechanism and insuring that the contacts remain in the OPEN position. The padlock is attached to the locking hasp by insertion of the link 21 through the hasp aperture 22 to hold the hasp in the extended direction and to prevent removal of the circuit breaker cover 12 as described earlier. The removal of the padlock allows the hasp slide 41 to move downward, guided by the rivets 44, 45 within the respective elongated slots 43, 46 under the urgence of the extended hasp spring 39 carrying the end 50 of the leaf spring 48 next to the top tab 40. should the contacts be in the CLOSED position, the operating mechanism closing shaft 25 and associated closing cam 29 would remain in the position shown in FIG. 2 to prevent movement of the locking hasp above the surface of the circuit breaker cover 12. Blocking the motion of the hasp slide 41 disables the padlocking mechanism by not permitting insertion of link 21 into the hasp aperture 22 In compliance with international code standards. This is an important feature of the invention since the external appearance of a padlocked circuit breaker cover would otherwise indicate that the contacts are in the OPEN position and that the associated electrical equipment was de-energized.

An arrangement has herein been described whereby a high-ampere rated industrial circuit breaker is prevented from having a padlock attached to the circuit breaker cover unless the circuit breaker contacts are positively in the OPEN position.

We claim:

1. An industrial-rated circuit breaker comprising:

an electrically insulative circuit breaker case and cover;

a pair of separable contacts within said case and arranged for connection with electrical equipment;

an operating mechanism within said case, said operating mechanism including a closing shaft for moving said contacts between OPEN and CLOSED positions and a latch assembly for latching and releasing said operating mechanism, said closing shaft includes a multi-surface cam on an outer perimeter, said cam being configured to define a first surface corresponding to said OPEN position of said contacts and a second surface corresponding to said CLOSED position of said contacts; and a locking hasp assembly arranged within said circuit breaker cover, said locking hasp assembly interacting with said closing shaft to allow attachment of a locking device to one end of said locking hasp assembly when said contacts are in said OPEN position, said hasp assembly includes a cam slide interconnected with a hasp slide, said hasp slide includes a hasp aperture and said hasp slide is arranged for moving above and below a top surface on said circuit breaker cover, said cam slide and said hasp slide are slidably arranged on a side wall of said operating mechanism, said cam slide includes a cam slide return spring for positioning an end of said cam slide against said first and second surface of said cam.

2. The circuit breaker of claim 1 wherein said cam slide includes a cam slide elongated slot and wherein a pair of first rivets attach said cam slide to a side frame by means of said cam slide elongated slot.

3. The circuit breaker of claim 1 wherein said hasp slide includes a hasp slide elongated slot and wherein a pair of second rivets attach said hasp slide to a side frame by means of said hasp slide elongated slot.

4. The circuit breaker of claim 1 wherein said first surface comprises a flat surface and said second surface comprises a node.

5. An industrial-rated circuit breaker comprising:

an electrically insulative circuit breaker case and cover;

a pair of separable contacts within said case and arranged for connection with electrical equipment;

an operating mechanism within said case, said operating mechanism including a closing shaft for moving said contacts between OPEN and CLOSED positions and a latch assembly for latching and releasing said operating mechanism, said closing shaft includes a multi-surface cam on an outer perimeter, said cam being configured to define a first surface corresponding to said OPEN position of said contacts and a second surface corresponding to said CLOSED position of said contacts; and a locking hasp assembly arranged within said circuit breaker cover, said locking hasp assembly interacting with said closing shaft to allow attachment of a locking device to one end of said locking hasp assembly when said contacts are in said OPEN position, said hasp assembly includes a cam slide interconnected with a hasp slide, said cam slide and said hasp slide are interconnected by means of a hasp spring.

6. The circuit breaker of claim 5 wherein said hasp slide includes a hasp aperture and said hasp slide is arranged for moving above and below a top surface on said circuit breaker cover.

7. The circuit breaker of claim 6 wherein said hasp slide includes a leaf spring having a first end arranged for interacting with said latching assembly.

8. The circuit breaker of claim 7 wherein said leaf spring includes a second end arranged for interacting with said cam slide.

9. The circuit breaker of claim 8 wherein said cam slide includes a top tab, said top tab capturing said second end when said circuit breaker contacts are in the CLOSED position to prevent movement of said locking hasp above said circuit breaker cover top surface.

10. The circuit breaker of claim 9 wherein said cam first surface contacts a front tab on said cam slide to move said cam slide away from said second end to thereby allow said locking hasp to move above said circuit breaker top surface.

* * * * *